United States Patent [19]

Lockwood

[11] 3,971,492

[45] July 27, 1976

[54] HOT MELT APPLICATOR GUN

[75] Inventor: Glynn H. Lockwood, Carmel Valley, Calif.

[73] Assignee: Lockwood Technical, Inc., Sand City, Calif.

[22] Filed: Sept. 30, 1974

[21] Appl. No.: 510,165

[52] U.S. Cl. ..... 222/146 HE; 222/323; 222/473; 219/230; 219/421; 251/113; 173/170; 222/153

[51] Int. Cl.[2] ..... B67D 5/32; B67D 5/62

[58] Field of Search ..... 222/146 HE, 191, 323, 222/324, 470, 473, 474, 153; 219/230, 421; 401/1-3, 188; 228/52, 53; 239/133, 134; 425/87; 251/111-113; 173/170

[56] References Cited

UNITED STATES PATENTS

| | | | |
|---|---|---|---|
| 2,007,707 | 7/1935 | Dodge | 222/324 X |
| 2,670,238 | 2/1954 | Lansing et al. | 239/133 X |
| 3,219,279 | 11/1965 | Peeps | 251/112 X |
| 3,281,576 | 10/1966 | Cooper et al. | 222/146 HE X |
| 3,393,676 | 7/1968 | Kummer et al. | 239/133 X |
| 3,587,930 | 6/1971 | Schultz | 222/146 HE |
| 3,602,399 | 8/1971 | Litman et al. | 222/470 X |
| 3,847,233 | 11/1974 | Glover et al. | 173/170 |

FOREIGN PATENTS OR APPLICATIONS

| | | | |
|---|---|---|---|
| 1,916,100 | 10/1970 | Germany | 425/87 |
| 37,975 | 4/1956 | Poland | 239/133 |

*Primary Examiner*—Robert B. Reeves
*Assistant Examiner*—Charles A. Marmor

[57] ABSTRACT

The present hand gun receives pressurized hot melt adhesive and the like via a heated flexible hose. The operator's handle and the supply conduit for adhesive project in a common plane from opposite end portions of the gun barrel. Although generally parallel, the handle and conduit typically are inclined toward each other and are joined at their ends remote from the barrel, forming a rigid generally polygonal frame with ample opening between the handle and conduit to receive the fingers of a hand gripping the handle. The gun thus completely isolates the operator's hand from the path of supply of the molten material, while still permitting the hose to extend generally downward from the gun in most positions of use. The disclosed configuration further provides a well protected location for the control trigger. An improved safety latch for the trigger is disclosed. The swivel connection between gun and hose provides fully enclosed access for electrical wires.

4 Claims, 1 Drawing Figure

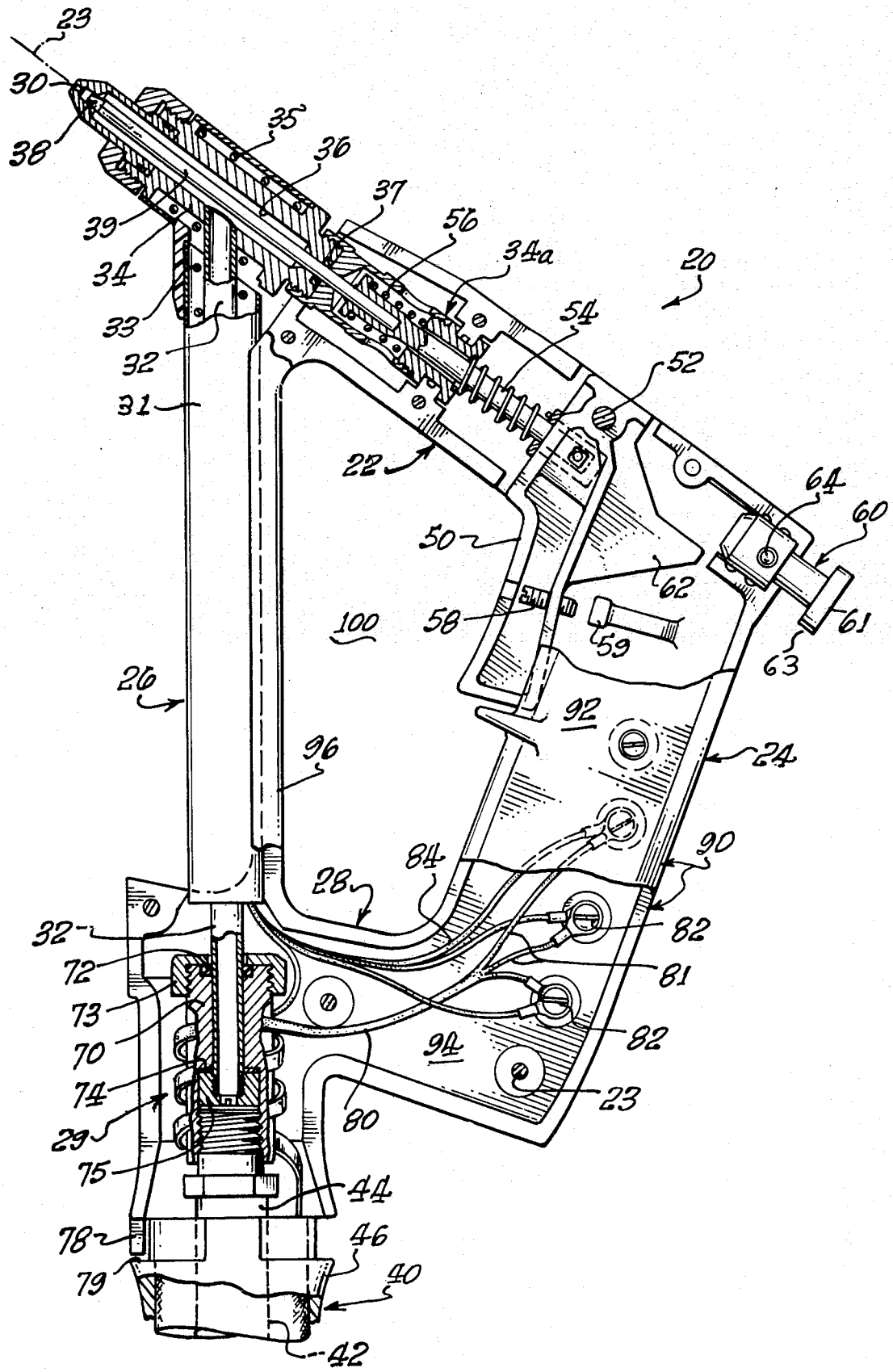
23
30
38
35
36
37
56
34a
20
39
34
33
32
31
54
52
22
64
60
50
62
100
58
59
61
63
26
92
24
96
90
84
28
82
32
72
81
73
70
82
94
74
23
29
80
75
44
78
46
79
40
42

HOT MELT APPLICATOR GUN

BACKGROUND OF THE INVENTION

This invention concerns hand tools for applying hot melt adhesive and the like to work surfaces.

Many such presently available hand tools, or hand guns as they are generally called, are supplied with adhesive in the form of solid cartridges or slightly flexible ribbon. U.S. Pat. No. 3,443,059, issued on May 6, 1969 to Robert A. Spencer and assigned to the assignee of the present application, is illustrative of such hand guns. Although useful for many purposes, such guns are not satisfactory for heavy work which requires the melting and application of large amounts of material.

For such relatively heavy work is is more satisfactory to employ a conventional source of pressurized molten adhesive or the like, which is supplied to the hand gun through a flexible hose. However, previously available hand guns operating on that principle are subject to serious disadvantages.

The flexible conduit or hose through which adhesive is supplied to the gun tends to be stiff and heavy, complicating accurate manipulation of the gun. That is especially true if the hose approaches the gun horizontally, since the operator's hand must then support an appreciable length of hose in addition to the gun itself.

In some hand guns for applying hot melt adhesive and the like the molten adhesive is supplied from below, entering the gun through the handle by which the operator grasps and manipulates the tool. U.S. Pat. No. 3,543,968 is illustrative of that configuration. However, despite the rather elaborate precautions described in that patent, it is difficult or impossible to reconcile the need to maintain the entering adhesive in molten condition and the need to protect the operator's hand from uncomfortable or harmful heat.

BRIEF DESCRIPTION OF THE INVENTION

The present invention avoids those and other difficulties by providing a hand gun structure of generally triangular, centrally apertured shape. The gun handle projects transversely from the rear portion of the barrel, forming with the barrel two sides of the triangle. The third side comprises heated conduit structure through which molten adhesive is supplied from below to the forward end portion of the gun barrel, closely adjacent the applicator nozzle.

The resulting structure is inherently rigid and compact. The supply hose approaches the tool from below, typically in a direction aligned with the conduit structure, to which it is connected adjacent the junction of the latter with the lower end of the handle. Moreover, the operator's hand grasps the gun handle with the fingers extending through the aperture of the gun structure, well spaced from the heated adhesive conduit.

The described configuration further permits the operating trigger to be positioned within the aperture of the generally triangular rigid structure, where it is inherently shielded from accidental operation.

The invention further provides improved means for connecting the supply hose to the gun with liquid-tight swivel movement and with fully enclosed feed-through between the hose sleeve and the gun housing for the electrical wiring needed for powering and controlling the necessary heaters. The invention thus avoids the cumbersome wire loops or separate electrical cables typical of previous hand guns.

DESCRIPTION OF THE DRAWING

A full understanding of the invention, and of its further objects and advantages, will be had from the following description of an illustrative manner of carrying out, reference being had to the accompanying drawing which is a somewhat schematic side elevation of an illustrative embodiment of the invention, partially broken away.

ILLUSTRATIVE EMBODIMENT OF THE INVENTION

The present illustrative embodiment comprises a generally flat structure 20 which includes three primary portions which are rigidly interrelated and form an effectively unitary whole. For clarity of description the gun will be assumed to be in the general orientation shown in the drawing, though it may be operated in any desired orientation. The barrel 22 carries the applicator nozzle 30 at its forward end, directed along the barrel axis 23. The handle 24 projects transversely from the rearward portion of barrel 22, typically in a generally downward direction as shown. The conduit structure 26 projects downward from the forward end portion of barrel 22 in the same plane as handle 24 and typically inclined toward the handle. Conduit structure 26 is preferably joined rigidly adjacent its lower end to the lower part of handle 24, either directly or via an angular bridge structure as indicated at 28. Adjacent that junction, and typically forming the lower end portion of conduit structure 26, there is provided coupling mechanism 29 for connecting the electrically heated and thermally insulated hose, indicated fragmentarily at 40, through which molten adhesive is supplied under pressure to the hand gun from suitable supply mechanism, not shown. Such supply mechanisms are well known, and do not require detailed description.

Conduit structure 26 includes the tube or conduit 32. The lower end of tube 32 is sealingly coupled via the transition fitting 44 to the tubular member 42 of hose structure 40, which terminates in the conventional cuff structure 46. The upper end of tube 32 is sealingly and rigidly anchored, as by silver solder, in an aperture in the cylindrical wall 34 of an adhesive chamber 36. That chamber is axially aligned with nozzle 30, with which it communicates via the control valve 38, typically a needle valve with conical seat and steeply tapered valve member formed on the end of the valve rod 39. That rod leaves chamber 36 through the seal 37. Electrical resistance wires, suitably insulated, are wound spirally about conduit tube 32 and about chamber wall 34 in the barrel, as indicated at 33 and 35, with the shielding sleeve 31.

Operation of valve 38 is controlled by the trigger 50, pivoted at 52. The trigger is coupled to valve rod 39 via the link 54, which is strongly urged forwardly by the spring 56, tending to hold the valve closed. The degree of opening of valve 38 in response to trigger operation is preferably adjustable, as by the stop screw 58, threaded in the trigger body and engaging the fixed stop 59.

Trigger action can be disabled by shifting the safety member 60, which is mounted at the rear end of barrel 22 for movement generally parallel to the barrel axis. As shown, member 60 is slidably mounted in guideways formed in the housing structure of the gun. It might alternatively be mounted for swinging movement at a relatively large radius. For example, member 60 may be formed with a downwardly extending arm that is pivotally mounted on the housing by structure generally similar to trigger pivot 52. Forward movement of member 60 from the released position shown in the drawing causes it to block the trigger boss 62 from upward movement, thereby immobilizing the trigger. A conventional detent, indicated at 64, retains safety member 60 in either its safety or releasing position unless purposely moved by the operator.

That safety structure configuration has the great advantage that the safety can be applied readily by the operator by direct pressure on the rearwardly facing surface 61, which is conveniently accessible to the thumb of the same hand that grasps handle 24. However, release of the safety requires the operator to grasp the flange 63 of member 60 with the other hand, virtually eliminating any possibility that the safety might be released inadvertantly.

Coupling structure 29 between tube 32 and flexible supply hose 40 typically comprises the bearing member 70, which slips over the threaded lower end of tube 32, forming with the latter a cylindrical plain bearing for relative rotation of the gun and hose. Liquid in the tube is sealed by the O-ring 72, retained by the nut 73. A thrust bearing is provided by the washer 74 of Teflon or similar material, which is retained by the nut 75 with a screw driver slot at its lower end. The transition fitting 44, already mentioned, is assembled to the tube 42 of hose assembly 40 by means of a flare fitting of convention design, not shown. The gun and hose are then assembled by screwing the lower end of bearing member 70 over the threaded upper end of fitting 44. That joint can be tightened by the hexagonal formations on fitting 44 and flat faces on the exterior of bearing member 70, the gun housing being sufficiently disassembled to provide access to those formations. Relative rotation of hose 40 and tube 32 may be limited in any suitable manner to an angle less than 360°. As illustratively shown, the housing boss 78 is received in the channel 79 of limited angle formed in the cuff structure 46 which forms the terminus of hose 40.

The flat electrical cable indicated at 80 is incorporated in the insulative shell of hose 40, emerging directly into the annular space between bearing member 70 and the housing which encloses it. The cable is preferably wrapped loosely about the bearing member, providing adequate slack to accommodate the rotary movement of the gun. The individual wires 81 of the cable are then led to the terminal screws 82, mounted in insulated relation in the housing. Connection is made from those screws via the wires 84 to the heater resistances 33 and 35, already described.

Much of the above described operating mechanism of the gun is enclosed by housing structure, typically molded of plastic material having a relatively low coefficient of heat conductivity. As shown, that housing comprises left and right housing members 92 and 94 which are substantially mirror images of each other, mating at a plane of symmetry parallel to the plane of the drawing. Those members are secured releasably together by the screws 95 to form the rigid and effectively unitary housing body 90. The housing members are designed with integrally molded internal flanges which fittingly grip and anchor in conventional fashion the mechanical portions of the mechanism, including specifically conduit 32 and the rearward extension 34*a* of chamber wall 34. Further, the housing directly forms the rearward portion of barrel 22 and virtually the entire handle structure 24 and bridge 28. Also, the housing body preferably includes a portion 96 which extends along at least the inner face of conduit 32 and its enclosing tube 31, forming a guard that prevents accidental contact with the conduit and greatly reduces the radiation of heat from the hot conduit toward handle 24. That housing portion, which is considered as part of conduit structure 26, further strengthens the housing body, completing the generally triangular frame structure and rendering the entire tool more sturdy and rigid.

An important advantage of the present configuration is that the handle can be given virtually any desired form, and may, for example, have a cross-section that is designed solely for the objective of providing a firm and comfortable grip. The handle design does not need to be compromised in order to fit around mechanism entirely foreign to the handle function, as would be the case, for example, if a heated conduit had to be accommodated within the handle. That freedom of design is especially helpful in providing a tool that is adapted for use by women.

In grasping the present handle, the operator's fingers typically extend through the polygonal aperture 100 formed by the barrel, the handle and the conduit structure. The width of that aperture between the conduit structure and the handle is made sufficiently wide, typically at least about 1½ inches, so that fingers enclosing the handle, even if wearing heavy work gloves, are well spaced from the conduit structure. The operator is then scarcely conscious of the high temperature of the conduit, and is neither injured nor fatigued by its presence.

In the preferred configuration shown in the drawing, the gun comprises an open frame of generally triangular shape, with the gun barrel and handle forming approximately a right angle and with the gun barrel and conduit structure forming more nearly an angle of 45°. Thus the shape may be considered to approximate a right triangle with the conduit structure as hypothenuse. However, the lower corner region of the triangle is preferably truncated, as at the bridge structure 28, thereby reducing the overall height of the structure and facilitating its manipulation. The rigid connection provided by bridge structure 28 between handle 24 and conduit structure 26 promotes strength and rigidity of the tool.

It will be evident that the proportions and angles of the structure can be varied widely without losing certain of the primary advantages of the present invention, though often at the cost of general efficiency and convenience. Also, for example, bridge section 28 might be made discontinuous, or omitted entirely, provided the remainder of the structure were correspondingly strengthened. However, it is preferred to retain the closed polygonal form, generally as shown. That is especially true since the portion of bridge 28 near the handle is also useful in defining the correct location of the operator's hand and helping to maintain the hand in that position. That action tends to increase accuracy of manipulation of the gun without requiring as tight a grip as would otherwise be needed.

I claim:

1. In combination with a hand gun for applying to a work piece molten adhesive and the like supplied under pressure from an adhesive source via a heated flexible hose, said hand gun including a nozzle for directing adhesive forwardly from the gun, normally closed valve means for controlling flow through the nozzle, a handle, and trigger means accessible to a hand grasping the handle for selectively opening the valve means; housing structure for said hand gun comprising left and right housing members which are substantially mirror images of each other and are releasably joined in mating relation at a common plane of symmetry, said housing members integrally forming a rigid housing including three legs arranged in generally triangular configuration, said nozzle projecting in alignment from the forward end of one housing leg, a second housing leg extending downward approximately perpendicularly from the other end of said first housing leg and forming said handle, the third housing leg integrally interconnecting the forward end of said first leg and the lower end of said second leg, the three legs defining a generally triangular aperture for freely receiving the fingers of a hand grasping the handle, said housing members further integrally forming a hollow cylindrical cuff section of said housing adjacent the junction of said second and third legs, the cuff section having a cylindrical axis aligned with said third leg, said hand gun including a heated access tube shielded from said aperture by said third housing leg, the upper tube end communicating with said valve means and nozzle and the lower tube end projecting coaxially into the cuff section, and swivel means comprising a cylindrical fitting rigidly mounted on the end of said flexible hose and coaxially mounted on the access tube within said cuff section for coaxial rotation in hermetically sealed relation.

2. Combination according to claim 1 including electrical heating elements associated with the hand gun, and electrical power conductors enclosed with said flexible hose within a common sheathing and entering the gun housing in fully enclosed relation through said cuff section of the housing.

3. In combination with a hand gun for applying to a work piece molten adhesive and the like supplied under pressure from an adhesive source via a heated flexible hose, said hand gun including a housing with an elongated barrel portion and a handle extending transversely of the barrel axis, a nozzle at the forward end of the barrel portion for directing pressurized adhesive forwardly from the gun, normally closed valve means for controlling flow through the nozzle, and trigger means including a trigger which is accessible to a hand grasping the handle and is normally movable in response to finger pressure in a direction to open the valve means; safety mechanism comprising a boss positively coupled to said trigger means for movement along a predetermined boss path transverse of the barrel axis in response to said trigger movement, a safety member mounted in the gun housing for translational movement generally parallel to the barrel axis between a normal rearward position clear of the boss path and a forward position with a member portion projecting transversely into the boss path and thereby disabling the trigger, detent means for yieldingly retaining the safety member in each of its said positions, said safety member including an actuating portion which projects rearwardly through an axial bore in the housing and terminates in a rearwardly facing surface accessible to the thumb of a hand grasping the handle to receive direct forward thumb pressure sufficient to overcome said detent means and to shift the safety member to its forward position to disable the trigger, and said projecting portion of the safety member having such configuration as to be manually returnable to said normal position only by finger grip of a hand other than one grasping the handle.

4. Combination according to claim 3 wherein said trigger is pivotally mounted on a pivot axis perpendicular to the barrel axis and to the handle and includes an arm that extends rearwardly and generally radially with respect to the pivot axis, and said boss is mounted on the arm adjacent its rearward end.

* * * * *